US006889604B2

(12) United States Patent
Ernst

(10) Patent No.: US 6,889,604 B2
(45) Date of Patent: May 10, 2005

(54) LID FOR A REFUSE CONTAINER

(76) Inventor: Tibor Ernst, 39 Boulevard de la perspective, 1150 Bruxelles (BE)

( * ) Notice: Subject to any disclaimer, the term of this patent is extended or adjusted under 35 U.S.C. 154(b) by 0 days.

(21) Appl. No.: 10/226,052

(22) Filed: Aug. 22, 2002

(65) Prior Publication Data

US 2003/0024419 A1 Feb. 6, 2003

Related U.S. Application Data

(63) Continuation of application No. 10/168,285, filed as application No. PCT/EP00/13107 on Dec. 21, 2000.

(30) Foreign Application Priority Data

Dec. 21, 1999 (IE) ..... S1999/1078

(51) Int. Cl.[7] ..... B30B 1/00; B30B 15/06

(52) U.S. Cl. ..... 100/226; 100/229 A; 100/233; 100/246; 100/295; 220/908

(58) Field of Search ..... 100/229 R, 226, 100/246, 295, 233, 248, 229 A, 908, 247; 220/495.07, 908.1, 908.2, 495.01, 495.06, 4.21, 4.26, 625, 630, 324, 326; 53/527

(56) References Cited

U.S. PATENT DOCUMENTS 3,760,718 A * 9/1973 Adornetto ..... 100/227
3,838,635 A * 10/1974 Hardy ..... 100/215
3,927,786 A * 12/1975 Aboud ..... 220/4.01
3,997,072 A * 12/1976 Guth ..... 220/324
4,147,100 A * 4/1979 Dykstra ..... 100/48
4,331,074 A 5/1982 Behman
4,349,123 A * 9/1982 Yang ..... 220/495.07
4,658,720 A 4/1987 Massonnet
5,090,309 A 2/1992 Lai
5,405,041 A * 4/1995 Van Brackle ..... 220/495.07
5,517,907 A * 5/1996 Fox ..... 100/349
5,881,900 A * 3/1999 Meshorer ..... 220/495.07
6,314,874 B1 * 11/2001 Martorella ..... 100/226

FOREIGN PATENT DOCUMENTS

DE 94 02 110.4 5/1994

* cited by examiner

*Primary Examiner*—Allen Ostrager
*Assistant Examiner*—Jimmy Nguyen
(74) *Attorney, Agent, or Firm*—Porter, Wright, Morris & Arthur, LLP

(57) ABSTRACT

A lid 14 for fitting to an open-topped refuse container 10 has a compacting mechanism comprising a compacting plate 36 mounted under the lid, a telescopically adjustable actuating rod 42 mounted over the lid, and means 40 slidably coupling the plate to the rod through an aperture in the lid such that the rod may be manoeuvred from a storage position wherein the rod lies across the lid and the plate is drawn up under the lid to an operative position wherein the rod stands upright over the aperture and may be pushed downwardly through the aperture (as seen in FIG. 4) to push the plate down into the container.

12 Claims, 8 Drawing Sheets

LID FOR A REFUSE CONTAINER

CROSS-REFERENCE TO RELATED APPLICATIONS

This application is a continuation of U.S. patent application Ser. No. 10/168,285 filed on Sep. 24, 2002 which is the national stage of International Patent Application Number PCT/EP00/13107 filed on Dec. 21, 2000.

FIELD OF THE INVENTION

This invention relates to a lid for a refuse container, and to a refuse bin having such a lid.

BACKGROUND OF THE INVENTION

U.S. Pat. No. 4,658,720 describes a refuse bin comprising an open-topped container having a lid and a compacting mechanism mounted on the lid. The compacting mechanism is of a type comprising a compacting plate mounted under the lid, an actuating rod mounted over the lid, and means slidably coupling the plate to the rod through an aperture in the lid such that the rod may be manoeuvred from a storage position wherein the rod lies across the lid and the plate is drawn up under the lid to an operative position wherein the rod stands upright over the aperture and may be pushed downwardly through the aperture to push the plate down into the container. This type of compacting mechanism is referred to herein as "of the specified type".

The purpose of such mechanisms is to reduce the volume of domestic, kitchen, office or other waste, particularly in countries where householders are charged for rubbish removal on a volume basis or where refuse bags are subjected to a sales tax to discourage waste.

The present specification describes certain improvements to refuse bins having a lid-mounted compacting mechanism, in particular but not exclusively refuse bins having a compacting mechanism of the specified type.

SUMMARY OF THE INVENTION

According to the present invention there is provided a lid for fitting to an open-topped refuse container, wherein the lid has a compacting mechanism of the specified type mounted thereon, and wherein the actuating rod is adjustable in length.

The invention further includes a refuse bin comprising an open-topped refuse container having a lid as specified above.

There is also provided, as a further and independent invention, a refuse bin comprising an open-topped container having a lid and a compacting mechanism mounted on the lid, the bin further comprising an aperture in a wall of the container adjacent the base of the container and means for releasably attaching a store of a continuous length of detachable refuse bags externally to the container wall adjacent to the aperture, whereby successive bags may be drawn from the store, through the aperture and up to the top of the container.

There is also provided, as a still further and independent invention, a refuse bin comprising an open-topped container having a lid and a compacting mechanism mounted on the lid, wherein the container is assembled from at least two parts at least one of which may be substituted by a part of different dimensions to provide the container with different capacities.

There is also provided, as a yet further and independent invention, a refuse bin comprising an open-topped container having a pivoted lid and a compacting mechanism mounted on the lid, wherein the lid is biased towards a normally open position and means are provided for releasably retaining the lid in a closed position.

There is also provided, as a still further and independent invention, a refuse bin comprising an open-topped container having a lid and a compacting mechanism mounted on the lid, the lid further including an opening having a pivoted closure flap to allow waste to be placed in the bin without opening the lid.

BRIEF DESCRIPTION OF THE DRAWINGS

Embodiments of the inventions will now be described, by way of example, with reference to the accompanying drawings, in which.

Throughout the drawings the same or equivalent components have been given the same reference numerals.

DETAILED DESCRIPTION OF CERTAIN PREFERRED EMBODIMENTS

Figure 1:
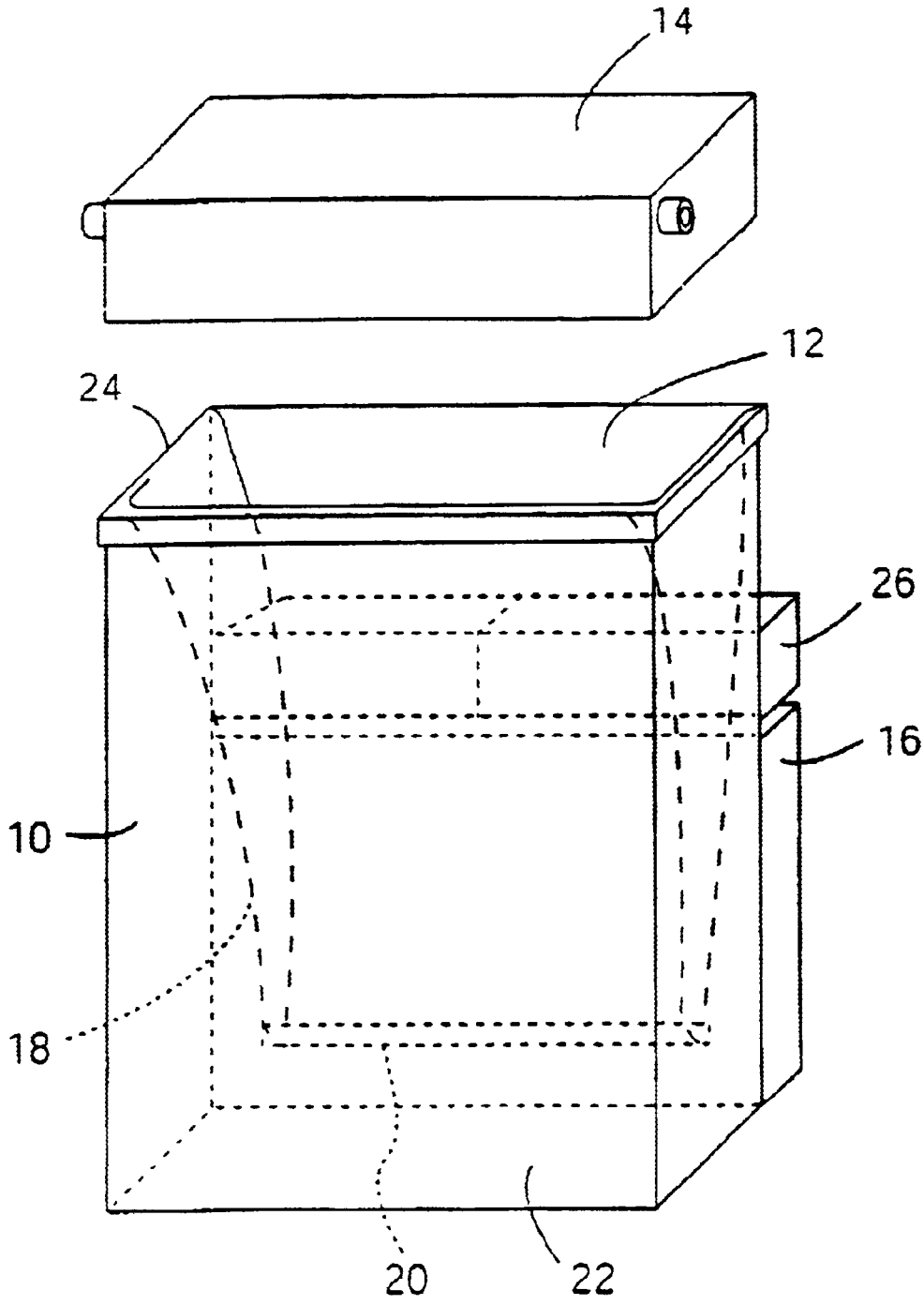
FIG. 1 shows a perspective front view of a first refuse bin having a replaceable cartridge of disposable refuse bags.

Referring to FIG. 1, a refuse bin comprises a container 10 having an open top 12 and a pivotally opening lid 14 (for clarity the lid is shown detached from the container). The lid incorporates a compacting mechanism (not shown) of the specified type. The construction of the lid and compacting mechanism are preferably as shown and described with reference to FIG. 4.

A cartridge 16 is releasably attached externally to the rear wall of the container 10 by brackets (not shown) and contains a continuous length of individually detachable plastic refuse bags 18 in a folded configuration, the head of each bag being detachably connected to the foot of its predecessor, e.g. by perforations or tapes. A horizontal slot 20 is formed in the rear wall of the container just above the base 22, and the cartridge 16 has a like slot (not shown) in register with the slot 20.

In use a plastic bag 18 is drawn from the cartridge 16, through the slot 20 and up to the top 12 of the container 10 where the open top of the bag is fixed around the top rim 24 of the container to receive refuse thrown into the container. The compacting plate of the compacting mechanism compacts the refuse in the bag 18. When the bag 18 is full it is tied off at the top (it may be provided with "bunny ears" for this purpose) and removed upwardly from the container. Removing the full bag 18 automatically draws a fresh, empty bag from the cartridge which, after detachment of the full bag, may be fixed around the container rim 24 as for the previous bag. This continues until all the bags in the cartridge 16 have been used, whereupon the empty cartridge is removed and a fresh cartridge installed.

This arrangement is important for hygiene and convenience reasons, since it allows the user to fit a bag semi-automatically without soiling his or her hands. Even if liquids or other waste escape from a bag into the interior of the bin, the remaining bags are separated from this spillage in the cartridge and so they remain clean.

FIG. 1 also shows a holder 26 located on the rear wall of the container, for holding small items.

Figure 2:
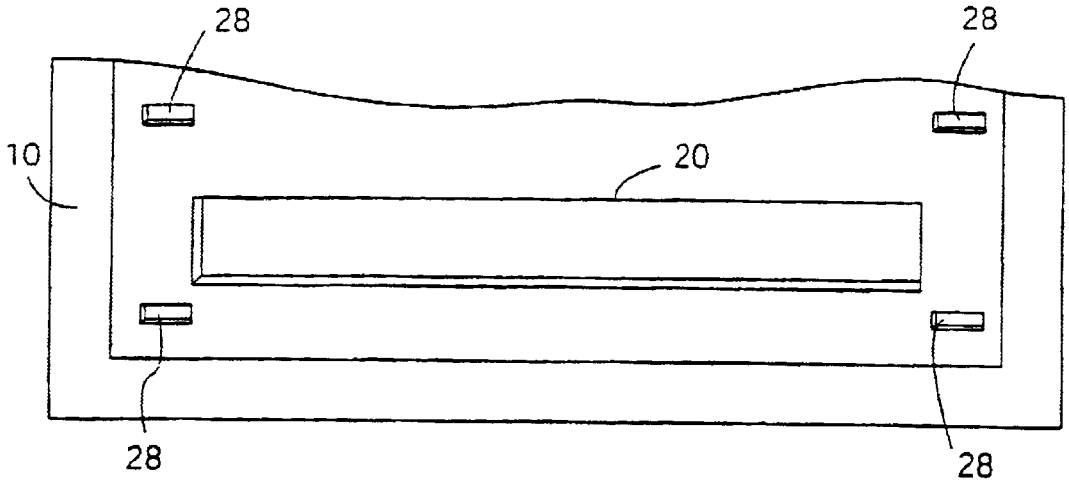
FIG. 2 is a rear view of the lower part of a second refuse bin for use with a replaceable cartridge of disposable refuse bags.
Figure 3:
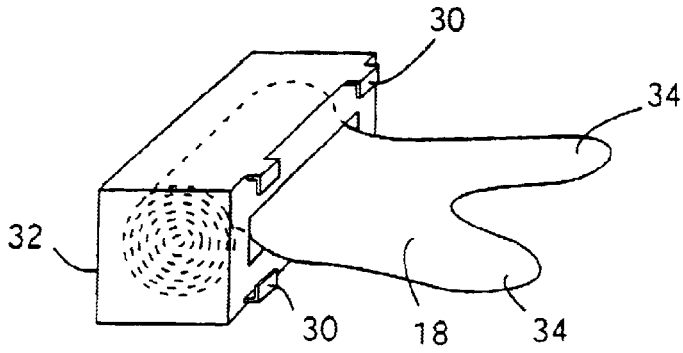
FIG. 3 is a perspective view of a refuse bag cartridge for use with the bin of FIG. 2.

In an alternative refuse bin, FIG. 2, the rear wall of the container 10 has four slots 28 each for receiving a corresponding lug 30 on the rear of a cartridge 32, FIG. 3. In the cartridge 32 the bags 18 are formed in a roll rather than being folded. Further, the leading edge of each bag has "bunny ears" 34 allowing the top of a full bag to be tied off, as previously mentioned. Although not shown, the bin shown in FIG. 2 has a lid and lid-mounted compacting mechanism as for FIG. 1.

Figure 4:
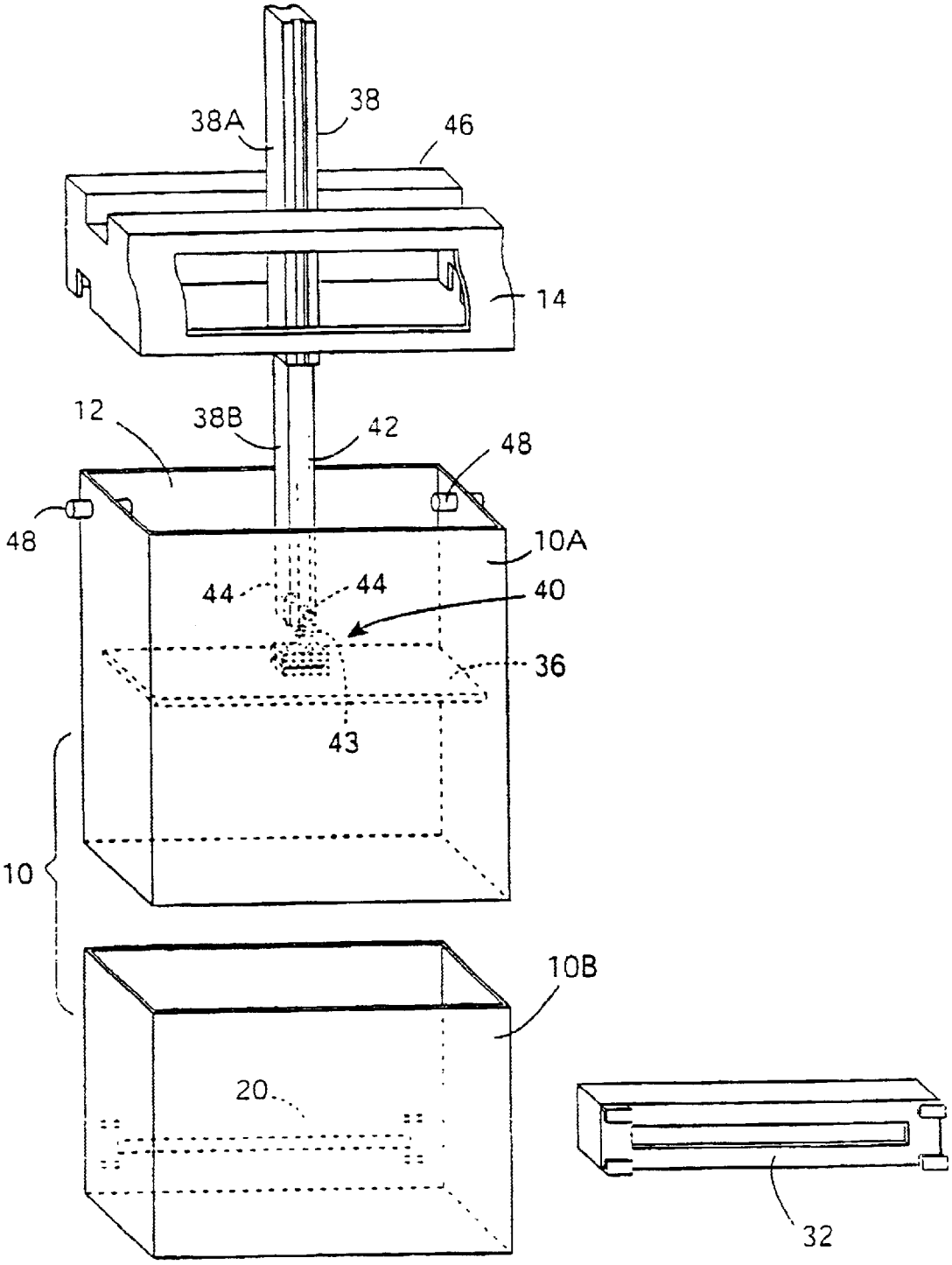
FIG. 4 is an exploded perspective view of a third refuse bin.

FIG. 4 shows a further refuse bin comprising a container 10 having an open top 12 and a pivotally opening lid 14. The lid 14 incorporates a compacting mechanism of the specified type and is pivoted to the open top of the container on pins 48.

The basic elements of the compacting mechanism are a compacting plate 36, an actuating rod 38 passing through an aperture (not shown) in the lid and means 40 slidably coupling the plate to the rod. The rod 38 is formed of two parts 38A and 38B telescoped one within the other, and has a groove or slot 42 along each of two opposite edges, the groove extending continuously along the two parts 38A, 38B. Means are provided (not shown) for locking the two parts 38A, 38B of the rod together at different longitudinal positions so as to adjust the effective overall length of the rod. The coupling means 40 includes a generally U-shaped bracket 43 having mutually inwardly facing free ends 44 which slidably engage in respective grooves 42.

In use, with the rod 38 vertical as shown, refuse in the container 10 may be compacted by pushing down on the rod from above the bin. When it is desired to store the compacting mechanism, the rod 38 is pulled vertically upwards until the free ends 44 of the bracket 43 project upwardly through the aperture in the lid and the plate 36 is drawn up under the lid. Now the rod 38 is rotated through 90 degrees to lie horizontally within a channel 46 in the lid 14, and slid longitudinally within the channel 46 to occupy the full length thereof. During such sliding the free ends 44 of the bracket 43 slide along the grooves 42. For storage the two parts 38A, 38B of the rod are unlocked and telescoped together so that the overall length of the rod 38 is substantially the same as the length of the channel 46, so that the rod does not overhang the channel at each end. Save for the telescopic rod 38 the compacting mechanism may be constructed as described in U.S. Pat. No. 4,658,720.

Figure 5:
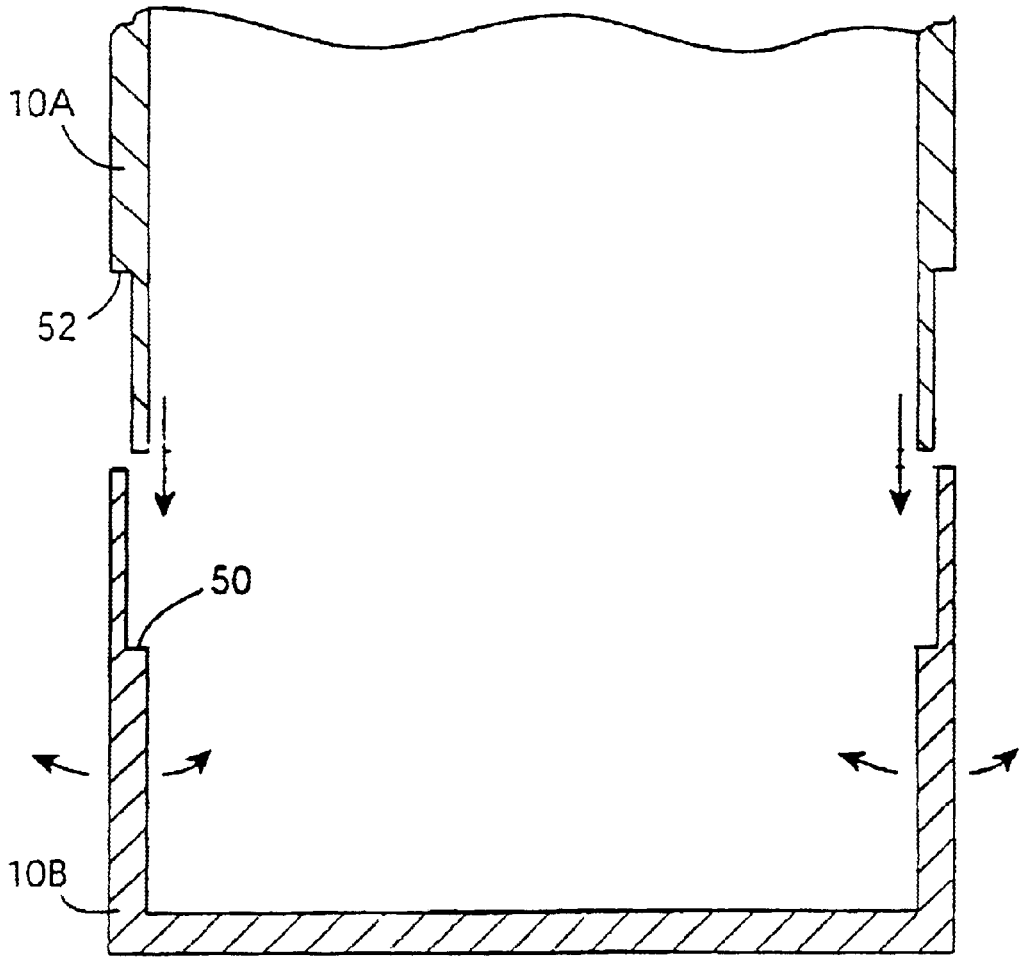
FIG. 5 is a cross-section through the lower part of the container of FIG. 4.

As shown, the container 10 is assembled from two parts, a body portion 10A and a base 10B. The body portion 10A is removably mounted on the base 10B in any suitable manner. One arrangement is shown in FIG. 5. Here the upper end of the base 10B has an internal step 50 while the lower end of the body portion 10A has a complementary external step 52 so that the body portion may be fitted into the base. The sidewalls of the base may be designed to flex outwardly slightly to facilitate insertion of the body portion.

This arrangement allows the capacity of the container 10 to be varied by substituting the body portion 10A and/or the base 10B with equivalent parts of different depth, and the telescopic construction of the rod 38 allows the length of the rod to be adjusted to suit different depths of container.

As an alternative to the rod 38 illustrated in FIG. 4, one may employ a telescopic mechanism having male and female arm members of circular cross-section which, when twisted by 90 degrees relative to one another, lock by means of a pin on one member locating in a groove on the other member.

As shown, the refuse bin shown in FIG. 4 has a slot 20 for refuse bags and a cartridge 32 for mounting adjacent the slot, as described previously.

Figure 6:
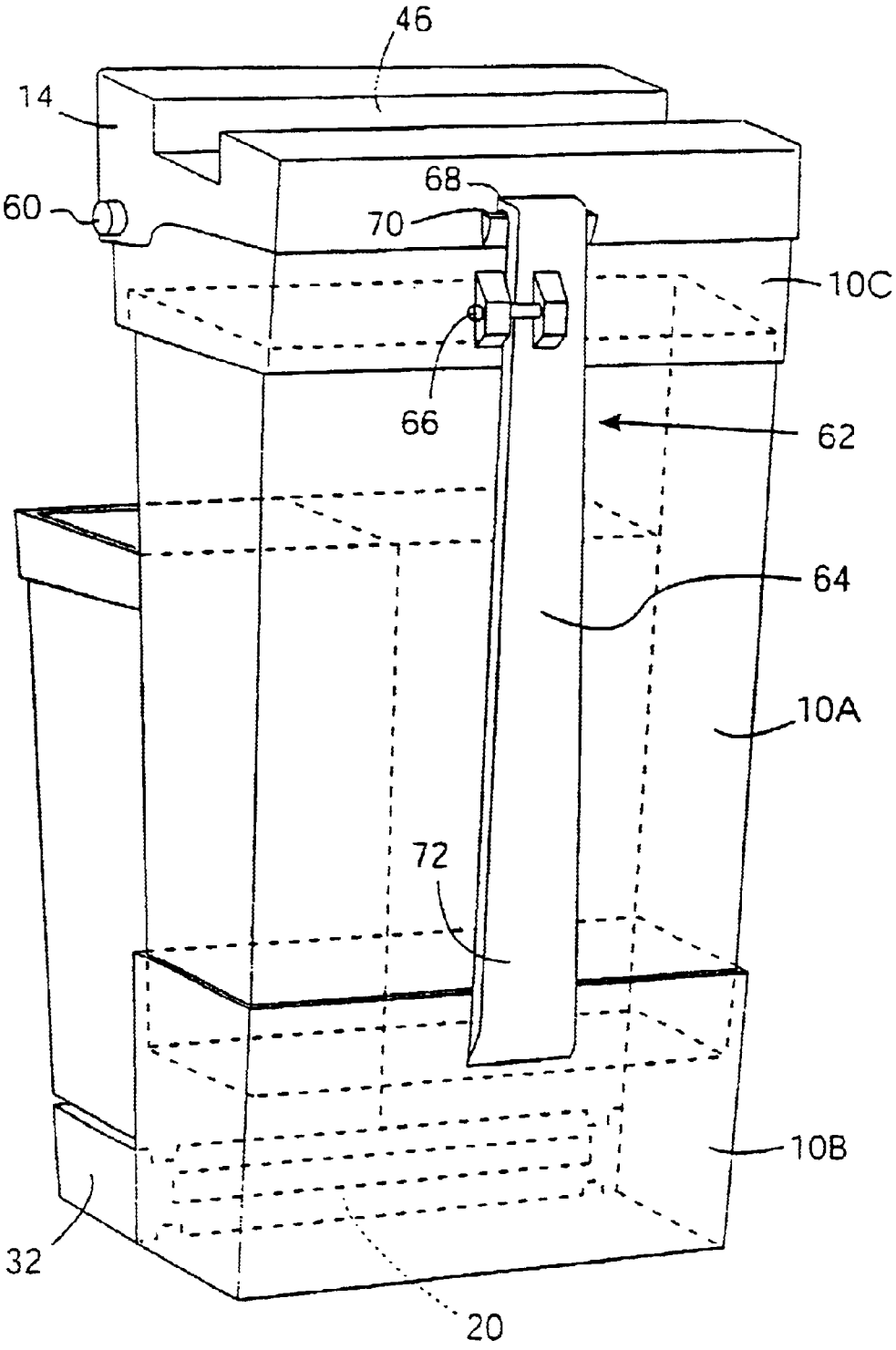
FIG. 6 shows a modification of the refuse bin of FIG. 4.

FIG. 6 shows a modification of the refuse bin of FIG. 4. Once again the container 10 is in modular form, but in this case it has three parts, a body portion 10A, a base 10B and a top sleeve 10C. The top sleeve 10C fits over the body portion 10A, allowing the top of a plastic bag from the cartridge 32 to be held between the top sleeve 10C and the body portion 10A. Any of these three parts may be substituted for equivalent parts of different depth to vary the overall capacity of the container.

The lid 14 is pivotally mounted to the top sleeve 10C on projections 60, and includes a compacting mechanism (not shown) as described for FIG. 4.

A biasing spring (not shown in FIG. 6) biases the lid 14 for rotation about the projections 60 to an open position, but the lid is retained closed by a catch mechanism 62. The catch mechanism comprises a generally vertical lever arm 64 pivotable about a fulcrum 66 on the front wall of the top sleeve 10C and having an inwardly directed projection or hook 68 at its upper end. The hook 68 engages a lip 70 on the front edge of the lid 14, the hook 68 being biased towards the lid 14 by a resilient member (not visible) mounted between the lever arm 64 and the front wall of the body portion 10A and which biases the lower end 72 of the arm 64 away from the body portion 10A.

In order to open the lid 14 the user momentarily depresses the lower end 72 of the lever arm 64 (suitably with a knee or foot) causing the hook 68 to retract from the lip 70, which releases the lid 14 to be urged upwards by the biasing spring. The lever arm 64, when released, reverts to its original position so that when the lid 14 is pushed closed again the hook 68 automatically engages the lip 70 to retain the lid 14 closed.

Figure 7:
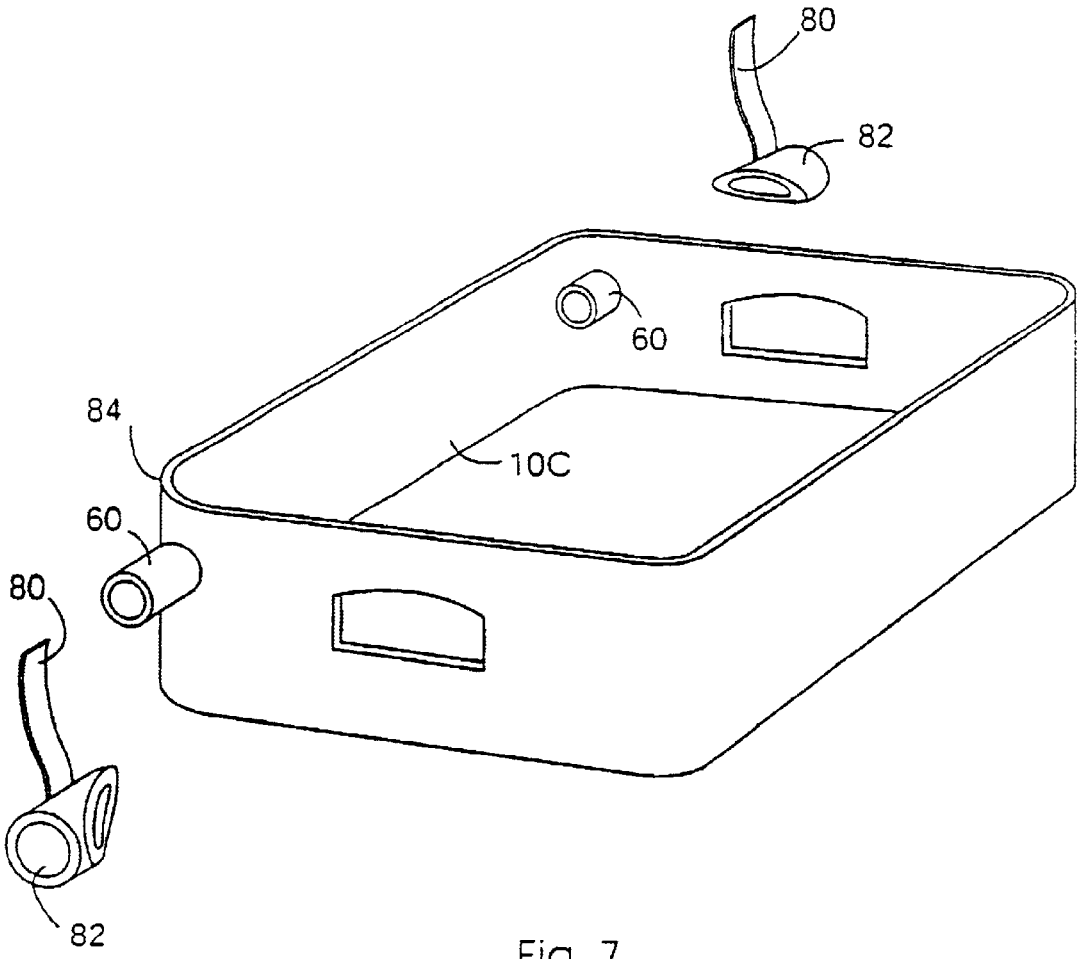
FIG. 7 shows details at the top of the bin of FIG. 6.

FIG. 7 shows the top sleeve 10C with the lid 14 removed. A leaf spring 80 is mounted on each projection 60. The leaf spring 80 is formed with a substantially cylindrical collar 82 which fits over the projection 60. The collar 82 is shaped to project partially around the rear corner 84 of the top sleeve 10C, thereby preventing the collar 82 from rotating relative to the projection 60 and ensuring that the leaf springs 80, in their relaxed position, are directed upwardly.

The lid 14 is then fitted onto the top sleeve 10C by means of holes in the lid which engage over the collars 82 on the projections 60. The lid is provided internally with a pair of recesses which respectively receive the leaf springs 80 in such a manner that when the lid is closed the leaf springs are resiliently deflected downwardly, thereby biasing the lid 14 to open as discussed above.

Figure 8:
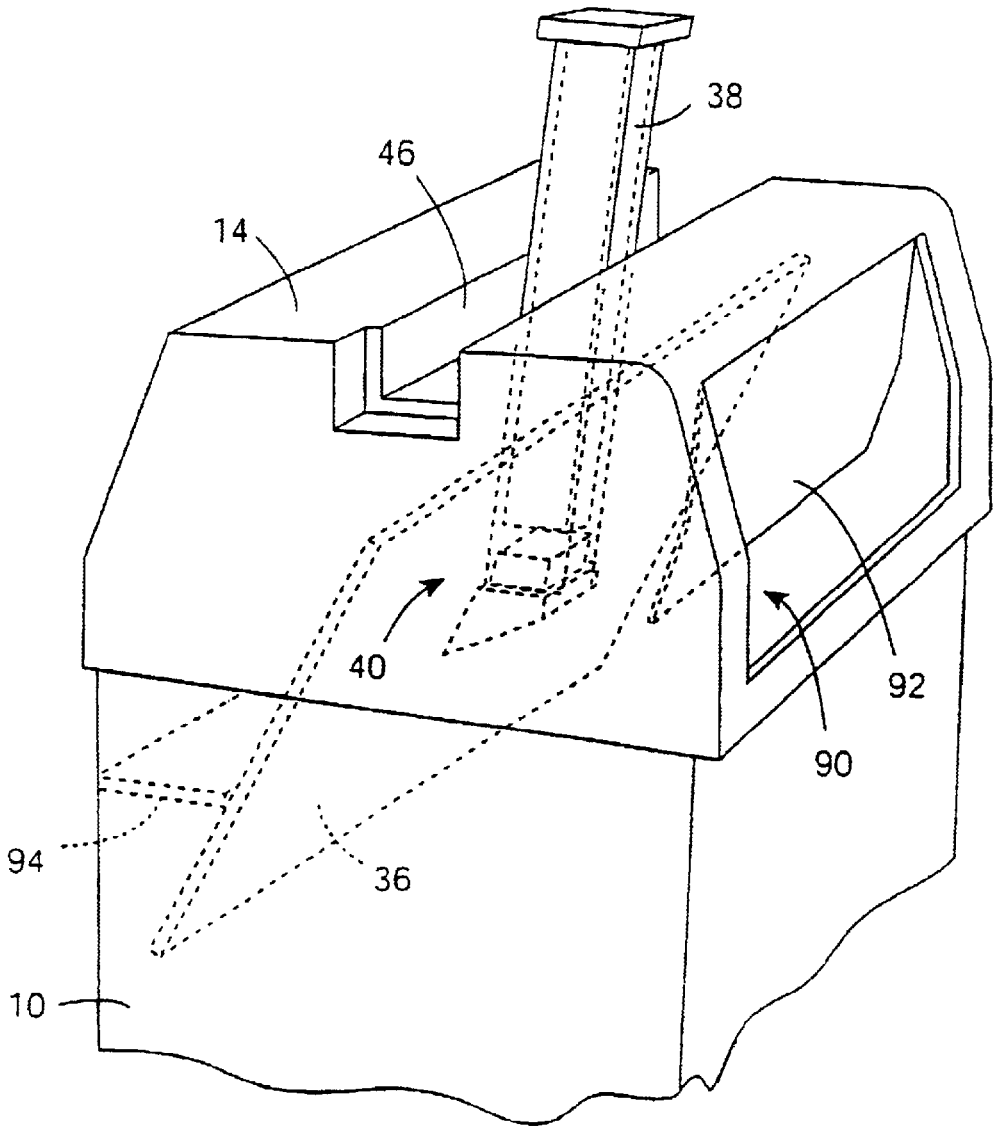
FIG. 8 shows the top end of a further refuse bin.

FIG. 8 shows a further refuse bin where the lid 14 has an opening 90 having an inwardly opening pivoted closure flap 92 to allow waste to be placed in the bin without opening the lid. This type of bin finds particular application in fast food restaurants whereby trays can be emptied quickly and easily, but where compaction of the waste would allow significant reductions in waste volume because the waste is predominantly empty space within and between lightweight containers.

In order to accommodate both the compacting mechanism and the flap 92 in the lid 14, and in particular to allow the flap 92 to open when the compacting plate 36 is accommodated in the storage position under the lid, an internal ledge 94 is provided on the container 10 which catches an edge of the compacting plate 36 when the compacting plate is lifted for storage as described earlier. This tilts the plate 36 away from the flap 92 and maintains the plate in this tilted position in its storage position (FIG. 8 shows the plate 36 being drawn up to, but not yet in, its storage position). The coupling 40 (the details of which are omitted from FIG. 8 for clarity) is therefore modified to allow such tilting.

Figure 9:
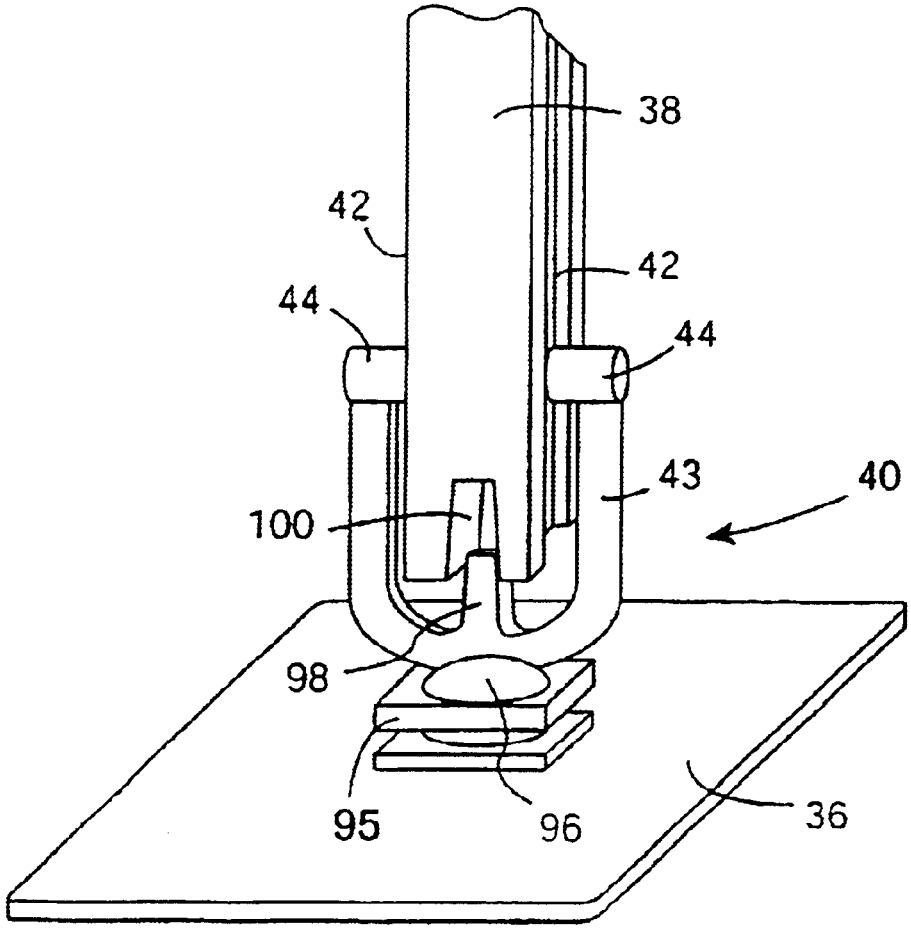
FIG. 9 shows the coupling between the rod and compacting plate of FIG. 8.

FIG. 9 shows the modified coupling 40, wherein a ball and socket joint is provided between the plate 36 and the bracket 43. In particular, the ball and socket joint comprises a cage 95 fixed to the bracket 43 and a ball 96 fixed to the plate 36, the ball 96 being loosely held in the cage to allow freedom of movement of the ball. Thus the plate 36 is free to tilt relative to the cage 95 with an accompanying partial rotation of the ball.

To avoid tilting of the plate 36 during compaction, the coupling 40 is designed to "lock up" when pressure is applied to the underside of the plate 36, i.e. when the plate is forced upwardly relative to the vertically oriented rod 38. This is achieved in two ways. First, a projection 98 on the bracket 43 enters a complementary aperture 100 in the end of the rod 38. This prevents movement of the bracket 43 relative to the rod 38. Second, upstanding projections (not shown) on the plate 36 enter complementary apertures in the underside of the cage 95. This prevents movement of the plate 36 relative to the bracket 43.

However, when the force on the underside of the plate is 36 is removed, for example, when it is being lifted by the rod 38 for storage, the various projections referred to above disengage their complementary apertures so that the plate 36 is once again allowed to tilt.

It will be understood that the features described in relation to any one of the refuse bins described herein may be incorporated in any of the other refuse bins, even where this is not explicitly stated.

The invention is not limited to the embodiments described herein which may be modified or varied without departing from the scope of the invention.

What is claimed is:

1. A lid for fitting to an open-topped refuse container, wherein the lid has a compacting mechanism mounted thereon and an opening having a pivoted closure flap to allow waste to be placed in the container without opening the lid, said compacting mechanism comprising a compacting plate mounted under the lid and an actuating rod coupled to the plate whereby the rod may be actuated to move the plate from a storage position wherein the plate is drawn up under the lid to an operative position wherein the plate is pushed downwardly into the container by downward movement of the rod through an aperture in the lid, wherein the compacting plate has two opposite edges and is pivotable as a whole on an end of the actuating rod between said opposite edges, and wherein the lid and container are adapted to cooperate to tilt the plate from a horizontal position as the plate is drawn up into the storage position by upward movement of the rod through the aperture so that the flap can be opened without obstruction by the plate, said tilting being effected by means on the container for restraining one of said two opposite edges of the compacting plate to thereby tilt the other of said two opposite edges of the plate upwardly away from the flap.

2. A lid as claimed in claim 1, wherein the plate is slidably coupled to the rod through the aperture in the lid such that the rod may is able to be manoeuvred from a storage position, wherein the rod lies across the lid and the plate is in said storage position, to an operative position, wherein the rod stands upright over the aperture and is able to be pushed downwardly through the aperture to push the plate down into the container, and wherein the actuating rod is adjustable in length.

3. A lid as claimed in claim 2, wherein the actuating rod is telescopically adjustable.

4. A lid as claimed in claim 2 or 3, wherein the plate is locked against tilting relative to the rod when the plate is forced upwardly relative to the upstanding rod.

5. A refuse bin comprising an open-topped refuse container, a lid for fitting to said container, said lid including an opening having a pivoted closure flap to allow waste to be placed in the container without opening the lid, and a compacting mechanism mounted on the lid, said compacting mechanism comprising a compacting plate mounted under the lid and an actuating rod coupled to the plate whereby the rod may be actuated to move the plate from a storage position wherein the plate is drawn up under the lid to an operative position wherein the plate is pushed downwardly into the container by downward movement of the rod through an aperture in the lid, wherein the compacting plate has two opposite edges and is pivotable as a whole on an end of the actuating rod between said opposite edges, and wherein the bin further includes means for tilting the plate from a horizontal position as the plate is drawn up into the storage position by upward movement of the rod through the aperture so that the flap can be opened without obstruction by the plate, said tilting means including means for restraining one of said two opposite edges of the compacting plate to tilt the other of said two opposite edges of the plate upwardly away from the flap.

6. A refuse bin as claimed in claim 5, further comprising means for releasably attaching a store of a continuous length of detachable refuse bags adjacent to the base of the container whereby successive bags may be drawn from the store up to the top of the container.

7. A refuse bin as claimed in claim 6, further comprising an aperture in a wall of the container adjacent the base of the container, wherein the store of refuse bags is releasably attached externally to the container wall adjacent to the aperture, whereby successive bags may be withdrawn from the store, through the aperture and up to the top of the container.

8. A refuse bin as claimed in claim 5, wherein the container is assembled from at least two parts.

9. A lid for fitting to an open-topped refuse container, wherein the lid has a compacting mechanism mounted thereon and an opening having a pivoted closure flap to allow waste to be placed in the container without opening the lid, wherein said compacting mechanism comprises a compacting plate mounted under the lid and an actuating rod coupled to the plate whereby the rod may be actuated to move the plate from a storage position wherein the plate is drawn up under the lid to an operative position wherein the plate is pushed downwardly into the container by downward movement of the rod through an aperture in the lid, wherein the compacting plate has two opposite edges and is pivotable as a whole on an end of the actuating rod between said opposite edges, wherein the plate is adapted to tilt from a horizontal position as the plate is drawn up into the storage position by upward movement of the rod through the aperture so that the flap can be opened without obstruction by the plate, and wherein the plate is tilted when one of said two opposite edges of the compacting plate engages a ledge having a fixed position relative to the aperture to thereby restrain the one of said two opposite edges and tilt the other of said two opposite edges of the plate upwardly away from the flap with the upward movement of the rod through the aperture.

10. A lid as claimed in claim 9, wherein the plate is slidably coupled to the rod through the aperture in the lid such that the rod is able to be manoeuvred from a storage position, wherein the rod lies across the lid and the plate is in said storage position, to an operative position, wherein the rod stands upright over the aperture and is able to be pushed downwardly through the aperture to push the plate down into the container, and wherein the actuating rod is adjustable in length.

11. A lid as claimed in claim 10, wherein the actuating rod is telescopically adjustable.

12. A lid as claimed in claim 10, wherein the plate is locked against tilting relative to the rod when the plate is forced upwardly relative to the upstanding rod.

* * * * *